US005267420A

United States Patent [19]

Segman

[11] Patent Number: 5,267,420

[45] Date of Patent: Dec. 7, 1993

[54] BUILDING CONSTRUCTION

[76] Inventor: Sam Segman, 1248 Glenhuntly Road, Glenhuntly, Victoria, Australia, 3163

[21] Appl. No.: 862,420

[22] Filed: Apr. 2, 1992

[30] Foreign Application Priority Data

Apr. 5, 1991 [AU] Australia ..... PK 5437/91

[51] Int. Cl.[5] ..... E04B 1/34

[52] U.S. Cl. ..... 52/292; 52/251; 52/73; 52/236.1

[58] Field of Search ..... 52/169.4, 234, 236.1, 52/236.5, 236.2, 292, 294, 296, 297, 260, 250, 251, 73

[56] References Cited

U.S. PATENT DOCUMENTS

| | | | |
|---|---|---|---|
| 745,315 | 12/1903 | Beaufait | 52/292 |
| 1,331,930 | 2/1920 | Keller | 52/292 |
| 3,460,446 | 8/1969 | Finsterwalder et al. | 52/251 |
| 3,514,909 | 6/1970 | Nevarez | 52/200 |
| 3,600,865 | 8/1971 | Vanich | 52/236.1 |
| 3,633,325 | 1/1972 | Bartoli | 52/296 |
| 3,910,002 | 10/1975 | Lough | 52/251 |
| 3,916,578 | 11/1975 | Forootan et al. | 52/292 |
| 4,100,705 | 7/1978 | Diana | 52/236.1 |
| 4,261,149 | 4/1981 | Gustafson | 52/292 |
| 4,332,116 | 6/1982 | Buchanan | 52/169.4 |

FOREIGN PATENT DOCUMENTS

| | | | |
|---|---|---|---|
| 0068735 | 6/1982 | European Pat. Off. . | |
| 2104951 | 7/1963 | France . | |
| 1556292 | 12/1968 | France | 52/236.1 |
| 1333929 | 4/1972 | France . | |
| 53033 | 4/1967 | Luxembourg . | |

*Primary Examiner*—Carl D. Friedman
*Assistant Examiner*—Winnie Yip
*Attorney, Agent, or Firm*—Jacobson, Price, Holman & Stern

[57] ABSTRACT

A building having a support, which may be a column (10, 11) or member (61) located in the ground and a supporting member (12) associated therewith and adapted to support floor sections (30) connected thereto and which cantilever outwardly therefrom. The floor sections (30) are preferably segmental and may support a central service module (55) which is the load bearing member for the building roof (50), the walls (40) being connected between the floor members (30) and the roof (50) but being non load bearing.

12 Claims, 4 Drawing Sheets 2
6
6
2
57
51
52
30
34
60
10
11
32
34
12
50
56
30
40
53
50
56
51
53
52
40
30
41

BUILDING CONSTRUCTION

BACKGROUND OF THE INVENTION

This invention relates to a building system, and specifically to a building construction which is pre-fabricated, can readily be erected on site and yet can be dismantled for re-erection should this be required.

There have previously been proposed many different types of prefabricated building constructions, but as a general rule these have all suffered from a major disadvantage that it is necessary to provide full foundations or footings of some description to enable the building to be built.

This means that there can be substantial initial time and expense in preparing a site for location of the building, particularly if the area concerned is sloping and, further, if the building is later dismantled there can be substantial work involved in returning the site to its initial condition.

SUMMARY OF THE INVENTION

It is an object of the present invention to provide a building construction which minimizes these difficulties.

It is a further object to provide a pre-fabricated building which is simple to erect and yet provides effective use of space.

The invention, in its broadest sense, includes a building having at least one support which is located on the ground surface, a pre-fabricated shaped supporting member which is adapted to be connected to the support and floor sections which can be connected to the supporting member and cantilever outwardly therefrom.

In a preferred form of the invention the support is a central supporting pier which extends upwardly from the ground surface, and the supporting member can be a preformed concrete cone which is adapted to fit over the pier.

Alternatively the support can be a slab mounted on the ground surface. Also, if required, more than one support can be used.

BRIEF DESCRIPTION OF THE DRAWINGS

In order that the invention may, be more readily understood it will now be described in detail with reference to the accompanying drawings showing one particular form of building made in accordance with the invention, and wherein.

DETAILED DESCRIPTION

Figures 1, 6:
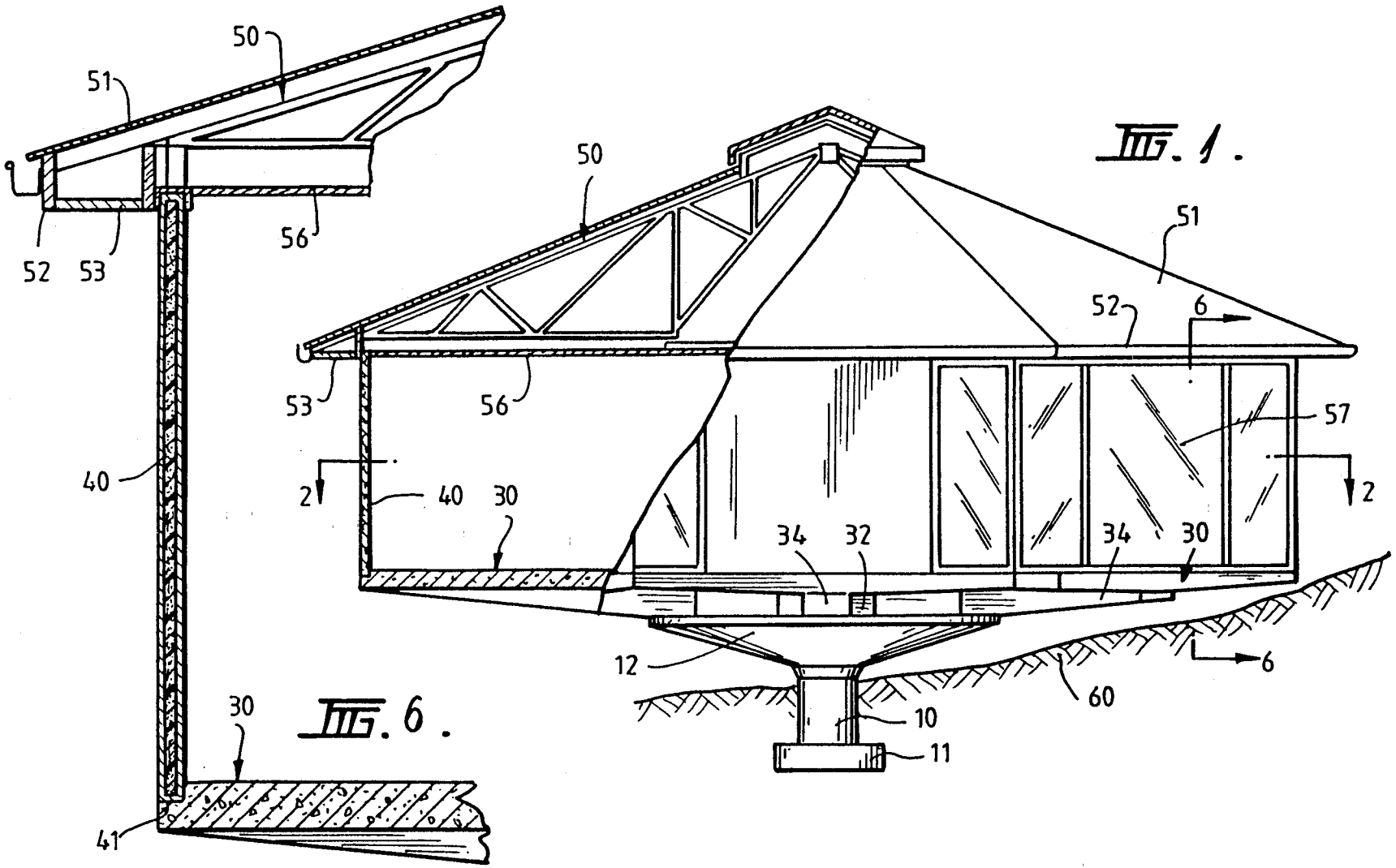
FIG. 1 is an elevational view partly in cross section of a building made in accordance with the invention.
FIG. 6 is a cross-sectional view taken along line 6-6 of FIG. 1 looking in the direction of the arrows and showing the inter-relation between the various components of the building.

A building in accordance with the invention using a central pier 10 can be formed in-situ and, typically, could be 600 mm in diameter, although this is not in any way restricting, and extends upwardly from the ground surface by a distance sufficient to ensure that the remainder of the building will be spaced from the ground 60.

This pier 10 may be located in any required manner which meets the necessary standards and may have a footing or plate 11.

Mounted on the pier there is conical support member 12 which may have in its lower surface a socket 13 whereby it can be received over the top of the pier 10 and which may extend outwardly and upwardly and have an outer periphery 14, upwardly directed, which is effectively horizontal when the support member is located.

The support member can be located with ground anchors based equally thereabout which assists the building in resisting wind loads, but this is not essential and is not illustrated.

Located on the support member 12, centrally thereof, there is a metallic support assembly 20 which comprises a bottom plate 21, a top plate 22, and a number of connecting members 23.

The bottom plate 21 can be provided with a number, in this case 4, apertures equally spaced around the periphery thereof and each of which are adapted to receive a rod 26 which may be cast into the pier 10 and which can extend through apertures in the support member 12.

The nuts 27 can be located on the top of these rods 26.

The upper plate 22 is also supplied with apertures which may have captive nuts 28 connected thereto which nuts are adapted to receive bolts 25 which pass through floor sections 30.

These floor sections are basically wedge shaped and, in the illustrated embodiment, there are eight such sections each of which has a forty five degree included angle at the center of the building.

The floor sections 30 each have an extension 32 which is adapted to rest on the horizontal surface 14 of the conical support member 12 and a flat surface 33 at its inner end which surface is adapted to abut the upper plate 22.

Figure 3:
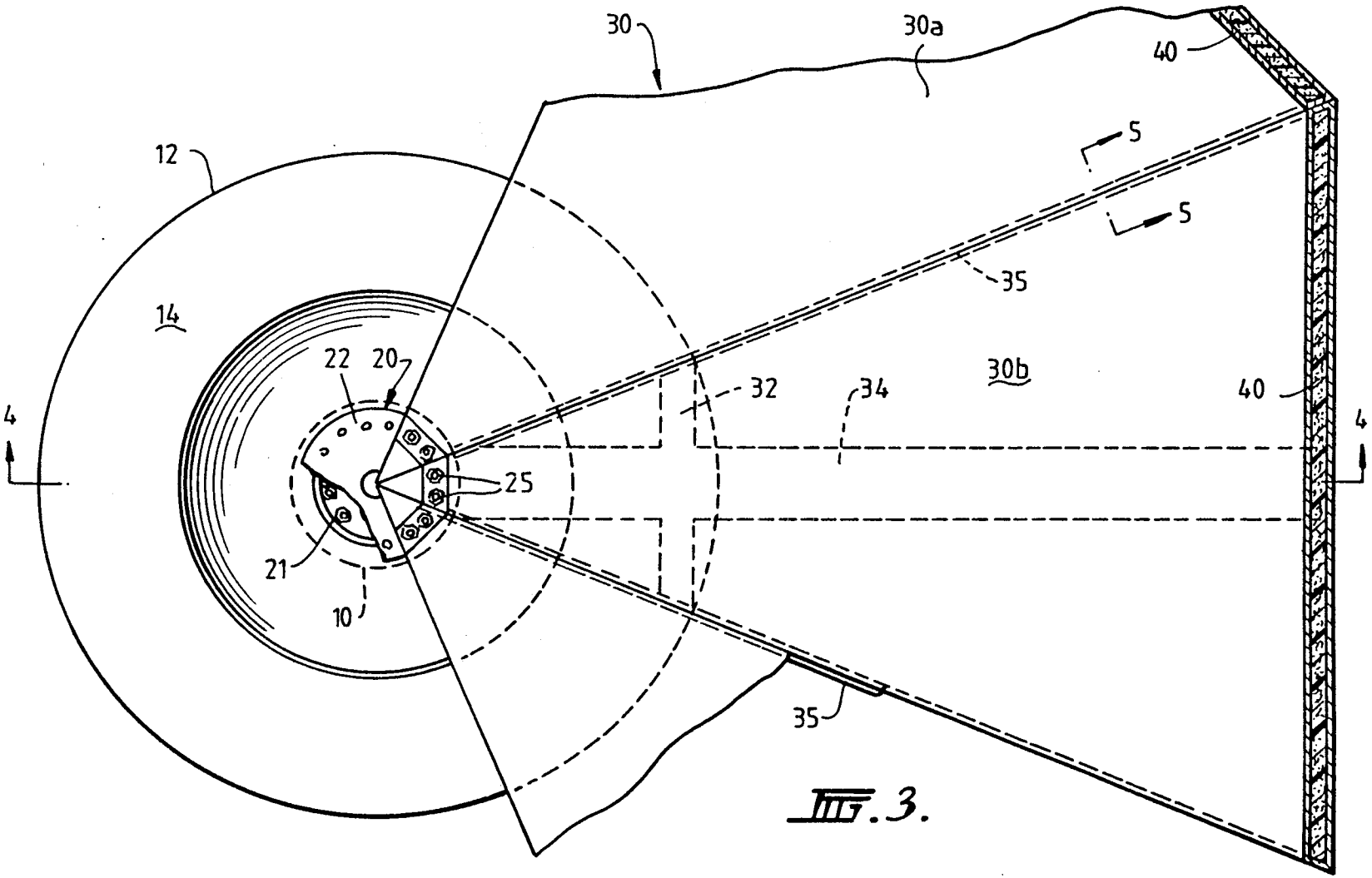
FIG. 3 is a broken plan view showing the various components which comprise the building.

This means that while a substantial part of the body 31 cantilevers, the cantilevering is from the extension 32. Each floor member 30 may also have a fillet or the like 34 which, is illustrated in FIG. 3 and extends effectively to full length of the member and provides rigidity thereto.

The segment is connected to the upper plate by means of bolts 25 which pass through apertures in the floor sections and are connected to the captive nut 28.

Alternatively, it will be appreciated, that if access apertures are provided in the conical member the nut need not necessarily be captive.

Figure 2:
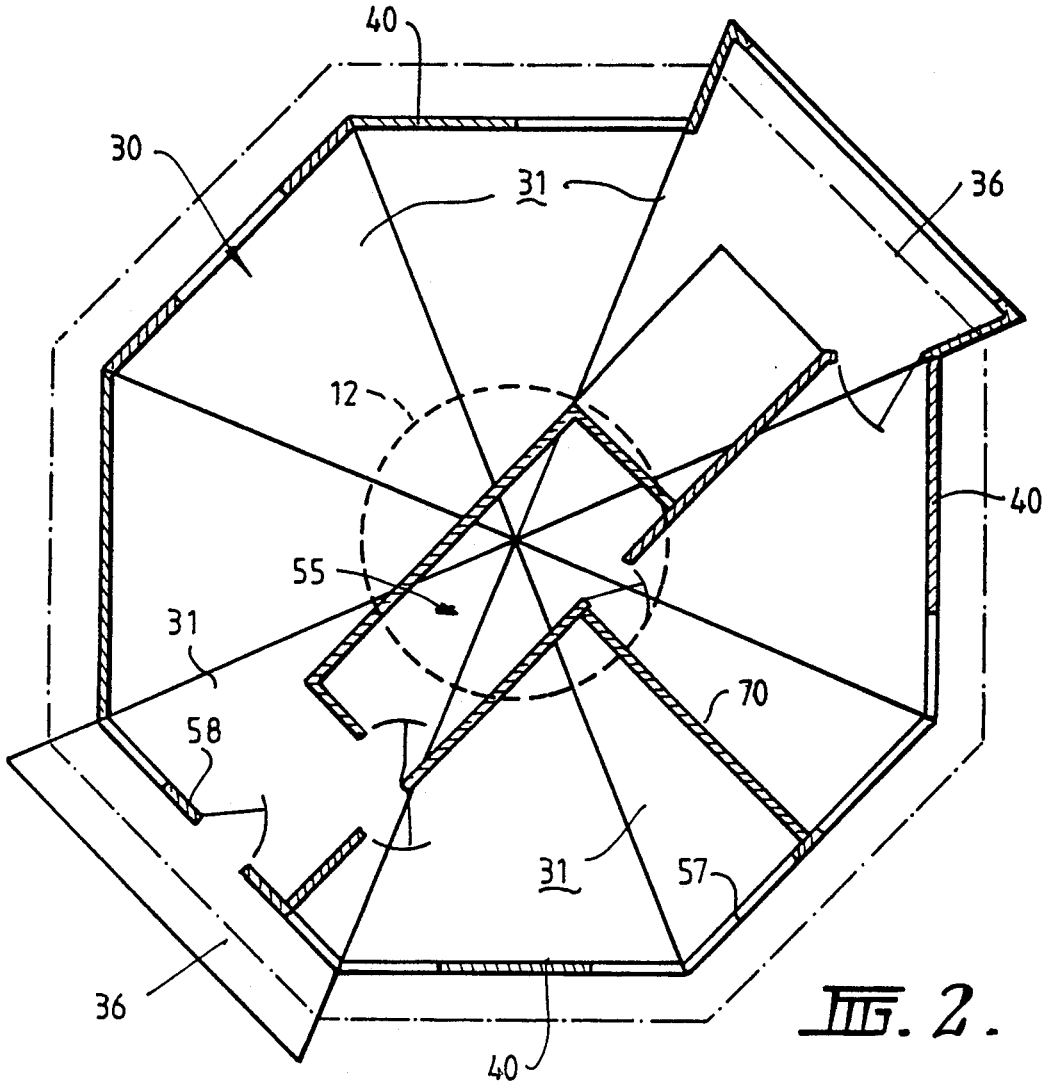
FIG. 2 is a cross-sectional view taken along line 2-2 of FIG. 1 showing the general layout of the building.
Figures 4, 5:
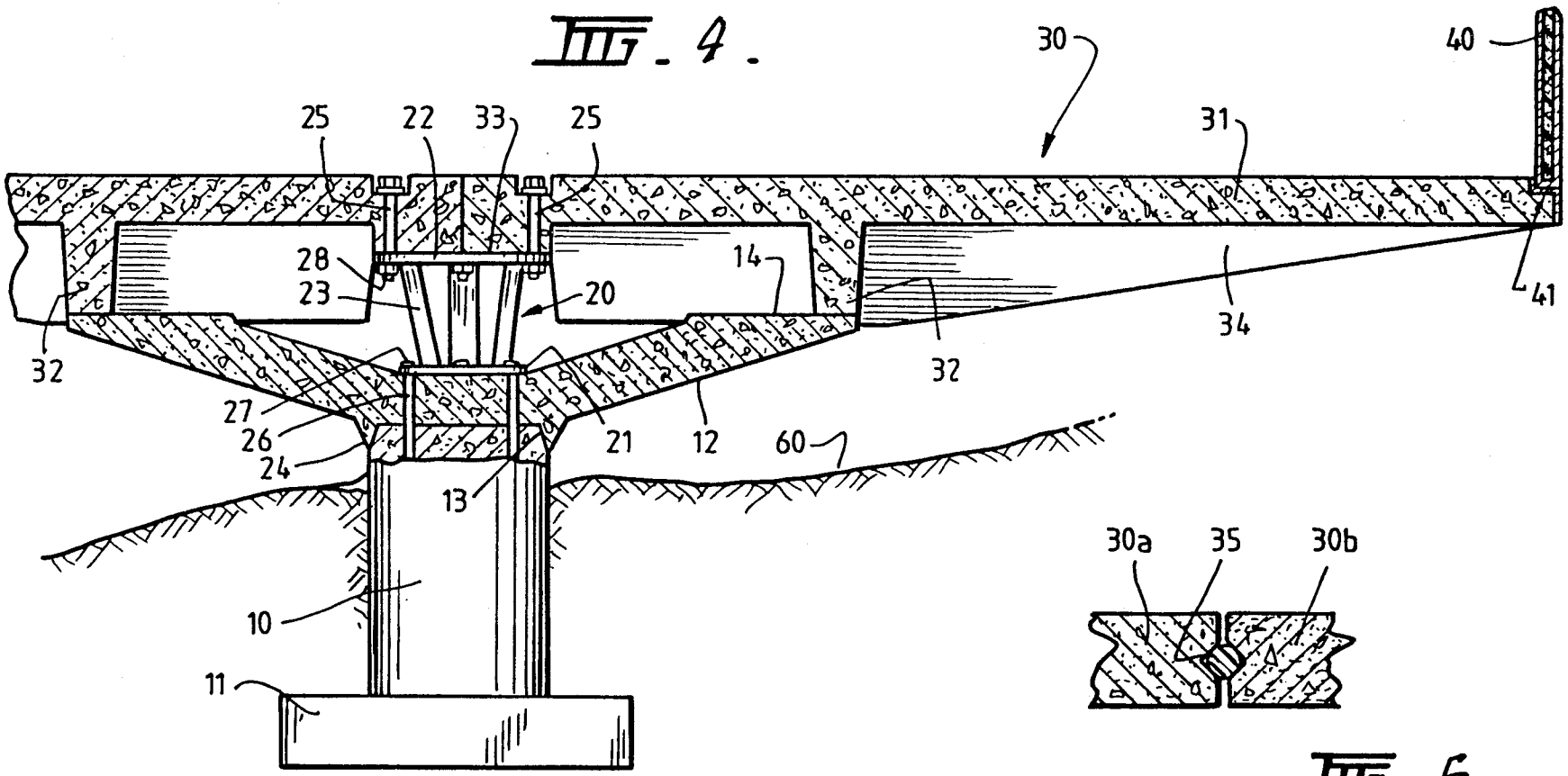
FIG. 4 is a cross-sectional view taken along line 4-4 of FIG. 3 showing the arrangement of the central pier, the support member and the floor slabs.
FIG. 5 is a cross-sectional view taken along line 5-5 of FIG. 3 looking in the direction of the arrows and showing the arrangement of adjacent floor panels.

The floor arrangement, as can be seen from FIG. 4 together with FIGS. 1 and 2, provides an octagonal base and individual floor members **30*a* and 30*b*, shown in FIG. 5, may have a resilient ring or the like 35** located therein to provide water and wind proofing.

If required, some or more of the sections 36 may extend outwardly beyond the other sections to provide, when the building is completed, entry porches or balconies or extensions.

It will be seen that when all of the slabs are located then while they are cantilevering from the conical support member 12, the turning moments about this member are basically neutral.

Each slab may have, at its outer periphery, a recess or the like 41 which is adapted to receive a wall panel 40 and there is preferably one wall panel for each slab and these, where they abut, are sealed and can be interconnected in any required way.

In a preferred form of building a central module 55 provides the various services, such as the kitchen, laundry, bath and WC. These are not illustrated on the drawings.

The module 55 can be provided as a pre-fabricated module or can be assembled on site and the central location permits the various services to be provided to the building through the cone.

This central module or wet cell may have a heavy load bearing metal frame and may rest on the floor under its own weight.

The load bearing frame can carry the load of the roof, the wall panels being on load-bearing.

The roof 50 may take any required form but the roof shown is sloping upwardly to a central point with each roof panel being in the form of a tapered triangle which, adjacent but internally of its outer edge 51, corresponds with the width of the wall members with which it is associated, and at its edge 52 is somewhat wider as it extends beyond the panel to form an eave 53.

Normal sealing is provided between adjacent roof panels and the roof and wall panels.

If the building has a sloping roof 50 as illustrated, the hot water tank and any air-conditioning plant can be located above the module 55 and beneath the roof.

The building as illustrated, has a conventional ceiling 56 but if the ceiling follows the roof line this area can be boxed in so that aesthetically the appearance is pleasing.

The remainder of the volume of the building can be divided into various rooms by the use of light weight panels as exemplified by reference 56 and various configurations can be provided which can include two or three bedrooms and a living area.

The wall panels 40 can be provided with windows 57 therein and in one preferred form of the invention some, at least, of these panels are basically substantially windows as these are not structural.

One of the panels 58 can provide an entrance comprising a sliding or opening door and, where this is provided, I prefer to use an extended floor slab, section 36 as mentioned earlier, to provide an entrance porch.

In this embodiment a particular form of octagonal building having a central pier has been described it is to be understood that the invention can readily be applied to a building having two or even more piers and even in such an arrangement there would be a great saving in the ground preparation to enable the building to be located.

Figure 7:
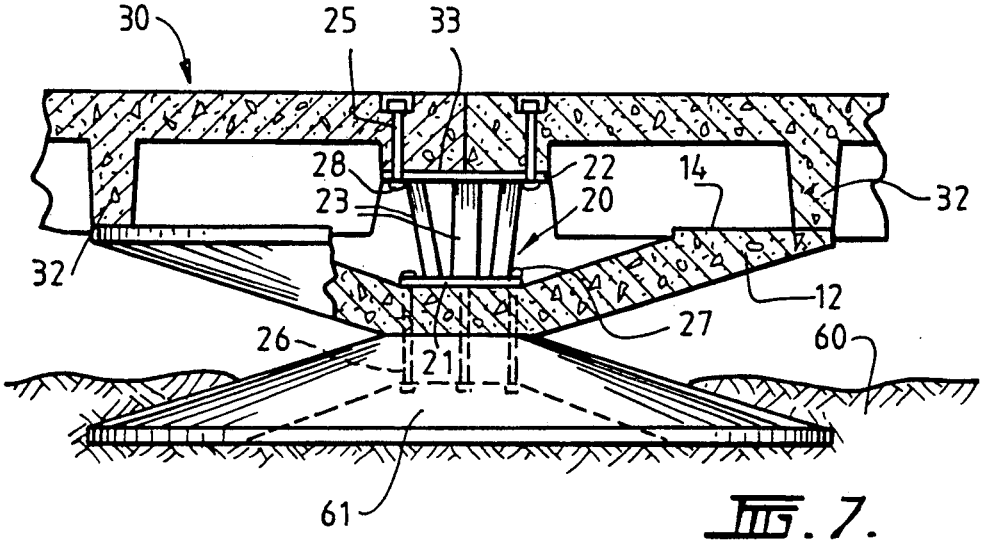
FIG. 7 is a view similar to FIG. 4 showing a different form of foundation arrangement.

In a further modification, illustrated in FIG. 7, instead of providing a central pier, if the ground is substantially flat alternatively a central slab 61 can be provided which is of a size to receive the conical support member 12, which may be formed similarly to the form described with relation to the pier. In the illustrated embodiment the formation is somewhat different in that it is not shown as having a socket 13. The slab 61 can, in fact, be identical to the conical support member 12 and it is so illustrated.

In this case the building is substantially closer to the ground to receive a socket surface but it is clear of the ground surface apart from the single point of connection which means that little or no preparation, other than the formation of the central slab, is required.

Although these have not been described particular forms of walls and a roof, other than as necessary to show the general operation of the system, it will be seen that the general arrangement is such that the building is effectively built from the bottom up, with the exception, that the central service area module 55 must be located after the floor has been completed and before the walls are fitted. The building can be readily disassembled in the opposite way, that is by removing the roof, then the wall panels, and then the central service module and floor slabs and finally the central support member. This leaves the area as it was before the building was located thereon, with the exception of the central pier which could be removed and destroyed or simply left in situ as a column on which, for example, plant growth could be established.

The building, apart from the central pier 10 can readily be prefabricated in a factory, which ensures that all of the components are made under full quality control and with dimensional stability and these can be freighted to the required area for assembly. If the slab 61 is an inverted conical support member, it could also be pre-fabricated.

Further, although there has been described a particular shape and construction materials in this specification, it is understood that both of these could vary substantially.

For example, any other suitable material could be used for the components, the conical support member 12 could be constructed from steel or timber and would not necessarily be specifically conical in form, and further the floor section could be prefabricated from other known building materials. There could also be quite substantial variations in the actual shape of the construction although it is preferred that it be substantially symmetrical about its support or supports.

I claim:

1. A building comprising:

at least one support located on the ground surface;

a pre-fabricated shaped supporting member in the form of an inverted truncated cone adapted to be connected to said at least one support;

a plurality of floor sections connectable to said supporting member for extending in cantilever fashion outwardly therefrom; and connection means for interconnecting said at least one support, said supporting means and said floor sections comprising:

at least one first rod means for demountably attaching said supporting member to said at least one support, plate means demountably attachable to said at least one first rod means, and a set of second rod means demountably attachable to said plate means and to said floor sections, so that said connection means is in tension and said floor sections are supported on said at least one support by said supporting means.

2. The building as claimed in claim 1 and further comprising:

at least one ground anchor connecting said supporting member to the ground to assist the building in resisting wind and other asymmetric loads.

3. The building as claimed in claim 2 wherein:

said at least one first rod means comprises a plurality of first rod members extending through said supporting member and each having a lower end anchored in said at least one support and an upper end removably connected to said connection means; and said second rod means comprise at least one second rod member extending through a respective one of said floor sections, each second rod member having a lower end removably connected to said connection means and an upper end removably engaging a respective floor section.

4. The building as claimed in claim 2 wherein:

said supporting member comprises an upper side, a lower side, a central portion and an outer peripheral portion;

said floor sections each comprise an upper side, a lower side, an inner portion and an outer portion;

said plate means comprise a lower plate member engaging said upper side of said supporting member at said central portion thereof, an upper plate member engaging said lower sides of said floor sections at said inner portions thereof, and a plurality of connector elements between said plate members and connecting said plate members to each other;

said at least one first rod means is removably connected to said lower plate member; and said second rod means are removably connected to said upper plate member.

5. The building as claimed in claim 4 wherein:

said at least one first rod means extends through said central portion of said supporting member, and has a lower end anchored in said at least one support and an upper end removably connected to said lower plate member; and said second rod means comprise at least one second rod member extending through said inner portion of a respective one of said floor sections, each second rod member having a lower end removably connected to said upper plate member and an upper end removably engaging a respective one of said floor sections.

6. The building as claimed in claim 5 and further comprising:

a depending extension on said lower side of each floor section engaging said peripheral portion of said supporting member.

7. The building as claimed in claim 4 and further comprising:

a depending extension on said lower side of each floor section engaging said peripheral portion of said supporting member.

8. The building as claimed in claim 1 wherein:

said supporting member comprises an upper side, a lower side, a central portion and an outer peripheral portion;

said floor sections each comprise an upper side, a lower side, an inner portion and an outer portion;

said plate means comprise a lower plate member engaging said upper side of said supporting member at said central portion thereof, an upper plate member engaging said lower sides of said floor sections at said inner portions thereof, and a plurality of connector elements between said plate members and connecting said plate members to each other;

said at least one first rod means is removably connected to said lower plate member; and said second rod means are removably connected to said upper plate member.

9. The building as claimed in claim 8 wherein:

said at least one first rod means extends through said central portion of said supporting member, and has a lower end anchored in said at least one support and an upper end removably connected to said lower plate member; and said second rod means comprise at least one second rod member extending through said inner portion of a respective one of said floor sections, each second rod member having a lower end removably connected to said upper plate member and an upper end removably engaging a respective one of said floor sections.

10. The building as claimed in claim 9 and further comprising:

a depending extension on said lower side of each floor section engaging said peripheral portion of said supporting member.

11. The building as claimed in claim 8 and further comprising:

a depending extension on said lower side of each floor section engaging said peripheral portion of said supporting member.

12. The building as claimed in claim 1 wherein:

said at least one first rod means comprises a plurality of first rod members extending through said supporting member and each having a lower end anchored in said at least one support and an upper end removably connected to said connection means; and said second rod means comprise at least one second rod member extending through a respective one of said floor sections, each second rod member having a lower end removably connected to said connection means and an upper end removably engaging a respective floor section.

* * * * *